US006973748B2

(12) United States Patent
Rice

(10) Patent No.: US 6,973,748 B2
(45) Date of Patent: Dec. 13, 2005

(54) PAINTBALL GUNS

(75) Inventor: John Ronald Rice, Upper Tean (GB)

(73) Assignee: NPF Limited (GB)

( * ) Notice: Subject to any disclaimer, the term of this patent is extended or adjusted under 35 U.S.C. 154(b) by 0 days.

(21) Appl. No.: 10/250,079

(22) Filed: Jun. 2, 2003

(65) Prior Publication Data

US 2003/0221684 A1 Dec. 4, 2003

(30) Foreign Application Priority Data

Jun. 1, 2002 (GB) ..... 0212855

(51) Int. Cl.[7] ..... F41A 19/00
(52) U.S. Cl. ..... 42/69.01; 124/31; 124/71
(58) Field of Search ..... 42/69.01, 84; 124/32, 124/31, 71, 56, 73, 74, 77; 89/136

(56) References Cited

U.S. PATENT DOCUMENTS 4,255,859 A * 3/1981 Klieman ..... 33/715
4,757,629 A * 7/1988 Austin ..... 42/84
4,887,583 A * 12/1989 Lin ..... 124/40
5,301,448 A * 4/1994 Petrick et al. ..... 42/70.01
5,402,678 A * 4/1995 Fritz et al. ..... 73/167
5,413,083 A * 5/1995 Jones ..... 124/32
5,727,538 A * 3/1998 Ellis ..... 124/77
5,890,479 A * 4/1999 Morin ..... 124/31
5,947,100 A * 9/1999 Anderson ..... 124/45
6,003,504 A * 12/1999 Rice et al. ..... 124/73
6,109,252 A * 8/2000 Stevens ..... 124/51.1

* cited by examiner

*Primary Examiner*—Michael J. Carone
*Assistant Examiner*—Troy Chambers
(74) *Attorney, Agent, or Firm*—Vedder Price Kaufman & Kammholz, P.C.

(57) ABSTRACT

A paintball gun trigger system includes a trigger, an emitter arranged to emit light and collector arranged to receive an amount of the light that varies with the position of the trigger and produce a signal that varies with the position of the trigger. A controller is arranged to determine from the signal when the trigger has been pulled and released. In one embodiment, the light beam from the emitter is pulsed on and off and the signal from the collector is sampled at regular intervals. Variations in the pulsed collector signal are used to detect when the trigger has moved to a pulled position and a released position, and when the collector is swamped with light from another source.

71 Claims, 9 Drawing Sheets

PAINTBALL GUNS

BACKGROUND OF INVENTION

The present invention relates to paintball guns, also referred to as paintball markers, and, in particular, to trigger systems for paintball guns.

Paintball guns are generally operated by means of pressurized air and a family of these guns controls the firing of paintballs electronically. They, therefore, require some form of switch which is operated by a user actuating the trigger to produce a signal that initiates the firing cycle subject to any other logic criteria being meet, e.g., paintball sensing, circuit timing, bolt position, etc. The importance of the use of an electronic trigger is that the guns are required to operate at a very fast cycle time, typically with the ability to achieve rates of fire up to 30 shots per second. Also, the low force requirement of an electronic trigger enables the player to maintain high rates of fire relative to the lack of fatigue to the operator's trigger finger. Players, therefore, can achieve a very high number of switch actuations in a very short time period, typically when the gun is used in a semiautomatic mode where one shot is fired for one intentional trigger pull and release. This dictates that the switch must have high speed operation combined with a long cycle life, high repeatability, a low operating force and also be resistant to the harsh environment that it is used in. Typically, mechanical switches have suffered high failures due to wear, fatigue, contamination of the faces and corrosion.

One type of known switch is a micro switch. These are inexpensive and only require a low force for actuation. However, they have a limited life due to mechanical wear of the integral spring mechanism, which leads to switch bounce, which is an undesired oscillation of the switch mechanism. This, in turn, leads to rapid making and breaking of the switch contact, known as contact flutter, which can cause multiple shots to be fired when only one is intended. Other problems with micro switches are that their make/break point can vary due to manufacturing tolerances; they are also unable to handle very short cycle times, they can fail in a closed state, and they are prone to accidental discharge from impacts, for example, due to dropping the gun. Tactile switches are also used, but these suffer from similar problems to micro switches. It is also known to use Hall effect switches. These have the advantages of good repeatability and an ability to handle fast cycle times, but can be affected by external magnetic influences. Also, the fitting of the magnet in the trigger can be difficult and can add undesired weight to the trigger.

The present invention aims to overcome at least some of these problems by providing novel switching devices to paintball gun trigger systems.

SUMMARY OF INVENTION

Accordingly, the present invention provides a paintball gun trigger system comprising a trigger arranged to be movably mounted on a paintball gun so as to have a variable position, an optical sensor arranged to produce a signal, which varies with the position of the trigger, and a controller arranged to receive the signal from the sensor to determine therefrom when the trigger has been operated, wherein the sensor comprises an emitter arranged to emit light and a collector arranged to receive an amount of light, which varies with the position of the trigger, and to vary said signal in response to variations in said amount of the light.

The sensor may include an actuator member arranged to move in response to movement of the trigger so as to vary the proportion of light from the emitter that can reach the collector. The actuator member may, for example, be arranged to be moved between the emitter and the collector.

The trigger may be movable between a depressed position and a released position. The actuator member may have a blocking portion, which is arranged to block more of the emitted light when the trigger is in one of the released position and the depressed position than when it is in the other of said positions. In some embodiments, the actuator member may have a reflector thereon that is arranged to reflect an amount of light from the emitter to the collector, which amount is arranged to be greater when the trigger is in one of the released position and the depressed position than when it is in the other of said positions. In still further embodiments, the actuator member may have an aperture through which light from the emitter can pass to reach the collector when the trigger is in one of the depressed positions and the released position. Said one position can, in any case, be either the depressed position or the released position.

The present invention further provides a paintball gun trigger system comprising a trigger arranged to be mounted on a paintball gun and movable between a depressed position and a released position, a sensor arranged to produce a signal that varies with position of the trigger, and a controller arranged to receive the signal from the sensor to determine therefrom when the trigger is in the depressed position, and to control firing of the gun in response to operation of the trigger, wherein the controller is arranged to define a minimum depressed time for which the trigger must be held in the depressed position to initiate firing of the gun.

The minimum depressed time is preferably at least equal to, and more preferably greater than, the ring time of the gun, which is the time for which the gun will vibrate if dropped. The minimum depressed time is also preferably at least equal to, and more preferably greater than, the maximum time that the trigger can stay in a position which can fire the gun due to the gun being dropped or otherwise jolted or struck. This time will depend on the mass and length of the trigger and the trigger return force. The minimum depressed time will normally need to be at least 5 ms (milliseconds), and for most guns, will need to be at least 20 ms.

Preferably, the minimum depressed time is only effective after the trigger has not been pulled for a predetermined time. This predetermined time may be just long enough to cause the minimum depressed time requirement to be activated for the first shot in a series only, such that any subsequent shots fired within said predetermined time of a previous shot can be fired without the trigger being held in the depressed condition for the minimum depressed time. In this case, it may be about 25 ms or even up to 1.0 s (seconds). Alternatively, this predetermined time may be long enough to ensure that, during a normal paintball game, the minimum depressed time is not re-activated until the player leaves the paintball field. In this case, it may be of the order of 1 minute.

The present invention further provides a paintball gun trigger system comprising a trigger arranged to, be mounted on a paintball gun and movable between a depressed position and a released position, a sensor arranged to produce a signal that varies with position of the trigger, and a controller arranged to receive the signal from the sensor to determine therefrom when the trigger is in the released position, and to control firing of the gun in response to operation of the trigger, wherein the controller is arranged to define a minimum released time for which the trigger must be in the released position before a further trigger pull can be registered, that is, between the registering of subsequent trigger pulls.

Preferably, the sensing means is an optical sensing means. However, other forms of sensing means, such as piezoelectric sensors and Hall effect sensors, can also be used.

Preferably, the sensing means comprises an optical emitter arranged to emit light in pulses and a collector arranged to produce said signal such that it pulses between a lit value and an unlit value in response to said pulses of light, and the control means is arranged to monitor the lit, or the unlit, value of the signal, and to inhibit firing of the gun if the lit, or the unlit, value reaches a predetermined threshold.

The present invention further provides a paintball gun trigger system comprising sensing means arranged to produce a signal that varies with the position of a paintball gun trigger, and control means arranged to receive the signal from the sensing means, and to control firing of the gun in response to operation of the trigger, wherein the control means is arranged to define a released state threshold of the signal corresponding to a released condition of the trigger, and a depressed state threshold of the signal, which may be offset from the released state threshold, and which corresponds to a depressed condition of the trigger, and to register a pull of the trigger only if the signal reaches the depressed state threshold and to register a further pull of the trigger only after the signal has returned to the released state threshold.

The signal may be arranged to vary with the position of the trigger by measuring movement of the trigger directly, or, for example, by measuring the force applied to a force sensor either directly or indirectly by the trigger.

The signal can vary with the force on the trigger in a number of ways. For example, it can increase steadily as the force increases, or for most trigger arrangements where the trigger position varies with the amount of force applied to it, the signal can vary with the position of the trigger. Alternatively, it can vary in a stepped manner either with one step at each threshold or a number of steps over a range of values that covers the threshold values. The signal could even comprise a number of components, for example, with one component changing to indicate one of the thresholds and another component changing to indicate the other of the thresholds.

Preferably, the control means is arranged to control the paintball gun to fire one shot for each registered pull of the trigger. Alternatively, it could be arranged to fire some other predetermined number of shots per pull.

Preferably, the depressed state threshold corresponds to a depressed position of the trigger and the released state threshold corresponds to a released position of the trigger. This is because trigger movement is generally required to fire a paintball gun. However, a simple force sensor, such as a piezoelectric sensor, can be used, in which case, movement of the trigger may be very small.

Preferably, the depressed position and the released position are separated by a distance corresponding to a finger movement of at least 0.01 mm, preferably between 0.01 mm and 0.1 mm, for example, approximately 0.05 mm, or substantially 0.06 mm.

Alternatively, the sensor may be arranged to measure force applied to the trigger and the depressed state threshold correspond to a predetermined depressing force being applied to the trigger. In this case, the released state threshold preferably corresponds to a smaller predetermined depressing force being applied to the trigger. The depressed state threshold depressing force is preferably less than 1000 grams, more preferably less than 100 grams, and still more preferably between 10 and 50 grams, and yet more preferably of the order of 20 grams. The released state threshold depressing force can be substantially zero, or may be at a predetermined level above zero, such as 5 grams or 10 grams so as to ensure that release of the trigger can be effectively detected.

Indeed, the present invention further provides a paintball gun trigger system comprising an optical sensing means arranged to produce a signal that varies with the position of a paintball gun trigger, and control means arranged to receive the signal from the sensing means to determine therefrom when the trigger has been pulled, wherein the sensing means comprises an emitter arranged to emit light in pulses and a collector arranged to produce said signal such that it pulses between a lit value and an unlit value in response to said pulses of light, and the control means is arranged to monitor the lit or unlit value of the signal, and to inhibit firing of the gun if the lit or unlit value reaches a predetermined threshold. The unlit value might be affected by light from an external source swamping the device. The lit value might be affected by failure or partial blocking of the light source.

Preferably, the sensing means further comprises an actuator member arranged to move in response to movement of the trigger so as to vary the proportion of light from the emitter that reaches the collector.

The actuator member may be arranged to be moved between the emitter and the collector.

The actuator member has a blocking portion which is arranged to block the emitted light when the trigger is in a released position.

Preferably, the actuator member is arranged to allow light from the emitter to reach the collector when the trigger is in a fully depressed position.

The actuator member may have an aperture through which light from the emitter can pass to reach the collector when the trigger is in the fully depressed position. Alternatively, the actuator member may be shaped, such as by being tapered, so that movement of the actuator member varies the amount of light from the emitter reaching the collector.

Preferably, the lit value of the signal is used to determine the position of the trigger.

Preferred embodiments of the present invention will now be described by way of example only with reference to the accompanying drawings.

DETAILED DESCRIPTION

Figure 1:
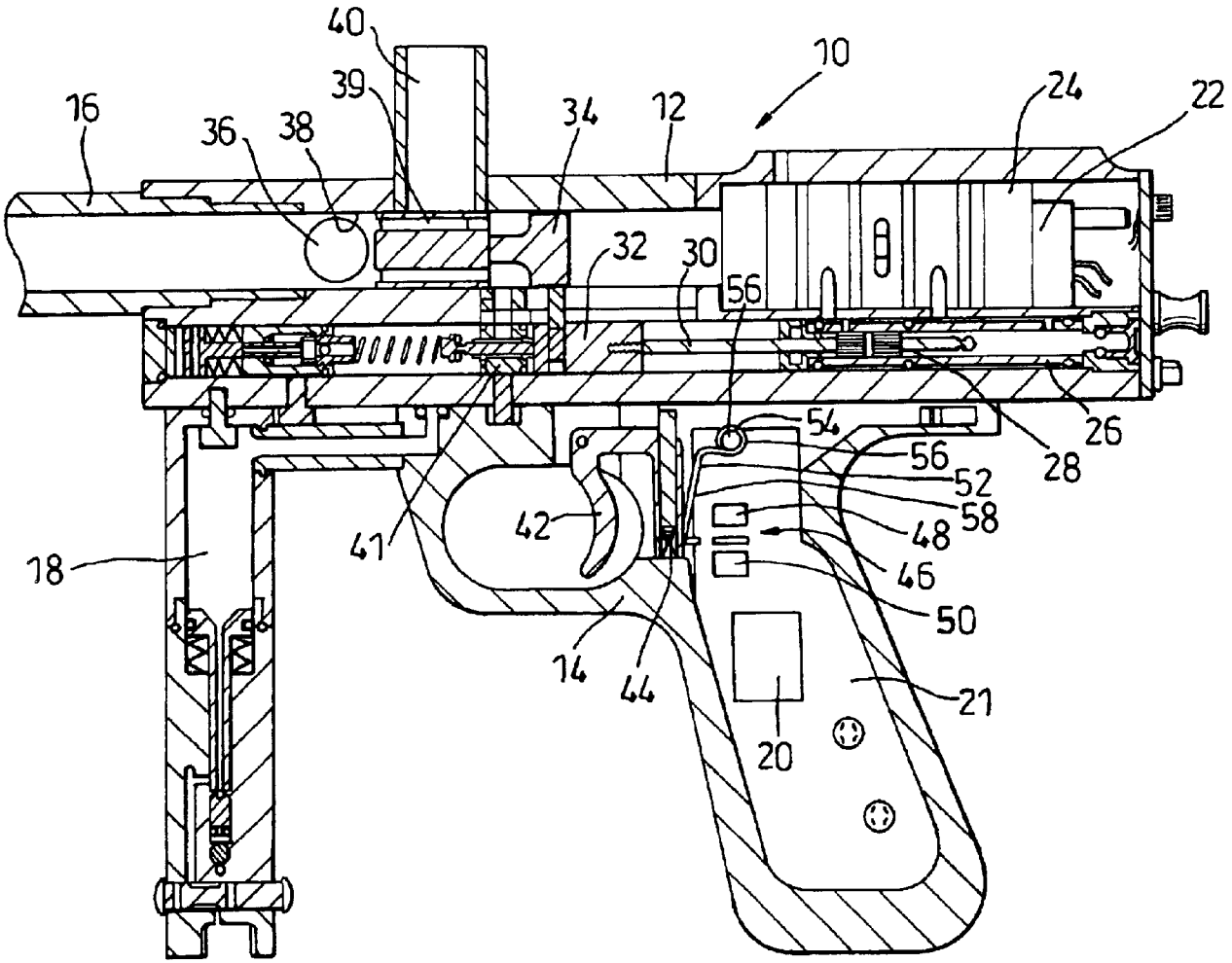
FIG. 1 is a side sectional view of a paintball gun according to a first embodiment of the invention.

Referring to FIG. 1, a paintball gun 10 has a main body 12, a grip frame 14, a barrel 16 and a gas inlet regulator body 18. A controller in the form of a control circuit 20 formed on a printed circuit board (PCB) 21 is mounted in the grip frame 14. The controller 20 controls a solenoid switch 22, which controls venting of a servo 24. The servo controls the flow of low pressure air to a cylinder 26, which moves a piston 28, rod 30 and ram head 32 to the left as shown FIG. 1. This also moves a bolt 34 to the left, carrying a paintball 36 in the breech 38 forward and sealing off a feeder port 40. The ram head 32 opens a poppet valve 34, which, in turn, allows high pressure air to flow through bores 39 in the bolt propelling the paintball along the barrel 16.

A trigger 42 is pivotably mounted on the grip frame 14 and is biased into a released position by means of a spring 44. An optical switch mechanism 46 is mounted on the PCB 22 and includes an optical emitter 48 and a collector 50, and an actuator spring 52. The actuator spring 52 is in the form of a strip of spring steel having its upper end 54 supported on a boss 56 on the PCB, a central portion 58 extending downwards. As shown in more detail in FIG. 2, the central portion 58 and has a trigger contact face 60 at its lower end. The lower end 62 of the actuator spring 52 is bent round just below the trigger contact face 60 so that it extends between the emitter 48 and collector 50. The lower end 62 has an opaque blocking portion 64, which blocks any light impacting on it, and an optical window 66, which allows light to pass through it. The trigger contact face 60 is in contact with an actuating face 68 on the trigger 42. Depressing the trigger 42 therefore moves the lower end 62 of the actuator spring 52 between the emitter 48 and collector 50, which varies the amount of the light in the light beam 70 produced by the emitter, which reaches the collector 50. The signal output by the collector 50, which varies with the amount of light incident on the collector 50, therefore varies with movement of the trigger 42, allowing the detection of trigger pulls, as will be described in more detail below.

The spring 44 can be omitted and the actuator spring 52 used to provide the return force to return the trigger 42 to the released position when it is released.

Referring also to FIGS. 3*a* to 3*f*, the emitter 48 is controlled so as to emit the infrared light beam 70 as a pulsed beam, which is switched on and off at a frequency of 500 Hz so that each pulse lasts 1 ms and the pulses are separated by gaps of 1 ms. The signal output from the collector 50 therefore comprises a pulsed component produced by any light 70 from the emitter 48 which reaches the collector, and a constant component produced by any background light reaching the collector 50. If the collector 50 receives pulsed light from any other source, then this will obviously produce a further pulsed component of the collector signal. However, the magnitude of the component of the emitter signal, which is pulsed at 500 Hz, is related to the amount of light reaching the collector 50 from the emitter 48. The collector signal is monitored and the times when it crosses each of the thresholds 231, 80, 38 detected. The crossing of one of the thresholds 231, 80, 38 indicates the occurrence of a pulse of the light from the emitter 48, and which thresholds 231, 80, 38 are crossed indicates the level of light reaching the collector 50 when the light emitter 48 is on and when it is off.

An alternative method of monitoring the signal would be to sample it, for example, at least twice in each pulse cycle, at least once in the first half of the cycle when the light beam 70 is off and at least once in the second half when the light beam is on.

Figure 3A:
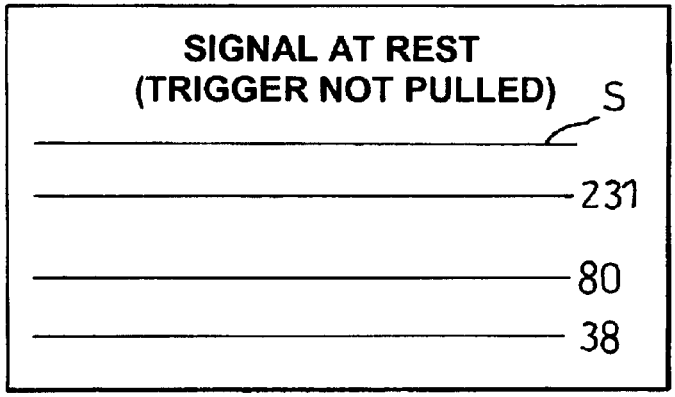
FIGS. 3*a*, 3*b*, 3*c*, 3*d*, 3*e*, and 3*f* are graphs showing how the signals in the trigger system of the gun of FIG. 1 vary with time under various circumstances.

Referring to FIG. 3*a*, the collector 50 can produce an output signal at any of 256 different levels. The controller 20 defines three threshold levels of the emitter signal which are used to analyze the movement of the trigger 42. The signal values are higher for lower levels of light received at the collector 50. A dark state threshold of 231 is set so that, if the signal is higher than the dark state threshold, substantially no light is reaching the collector 50. A fully depressed threshold of 38 indicates that a substantial proportion of the light from the emitter 48 is reaching the collector 50 and is defined as corresponding to the trigger 42 being in a fully depressed position. An intermediate released state threshold value of 80 is also defined. This corresponds to the light beam being on and the trigger 42 being in a released position, which need not be fully released.

Figure 3B:
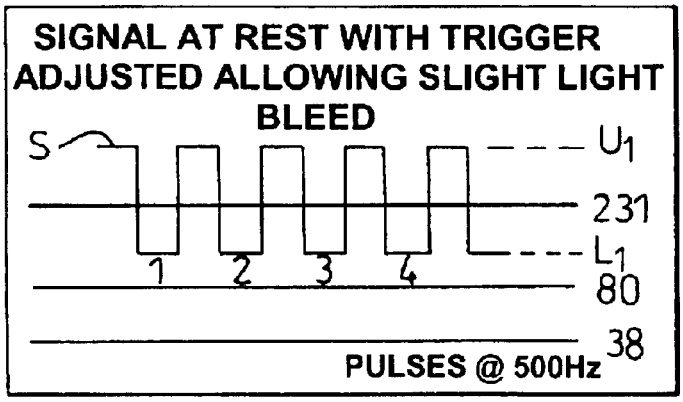

When the trigger 42 is in the fully released position, the blocking portion 64 of the actuator spring 52 blocks the light path between the emitter 48 and collector 50. If the trigger 42 is set up so that there is no light bleed to the collector 50, the collector signal S is constant, as shown in FIG. 3*a*. However, in practice, it is unlikely that all light from the emitter 48 will be blocked, and therefore, with the trigger 42 fully released, the emitter signal will appear as shown in FIG. 3*b*, comprising a series of low amplitude pulses as the signal oscillates between an unlit value $U_1$, which is above the dark state value 231, and a lit value $L_1$, which is between the dark state value 231 and the intermediate value 80. Therefore, on each pulse, the signal passes through the dark state threshold 231, but does not reach the intermediate threshold 80 or the fully depressed threshold 38. Having the trigger 42 set up to produce this oscillating signal, which passes through the dark state threshold 231 on each pulse with the trigger 42 fully released, can be useful to check that the light pulsing is working correctly as will be described below, and allows the pulses to be used as a clock signal because each pulse of the emitter 48 will be detected.

Figure 2:
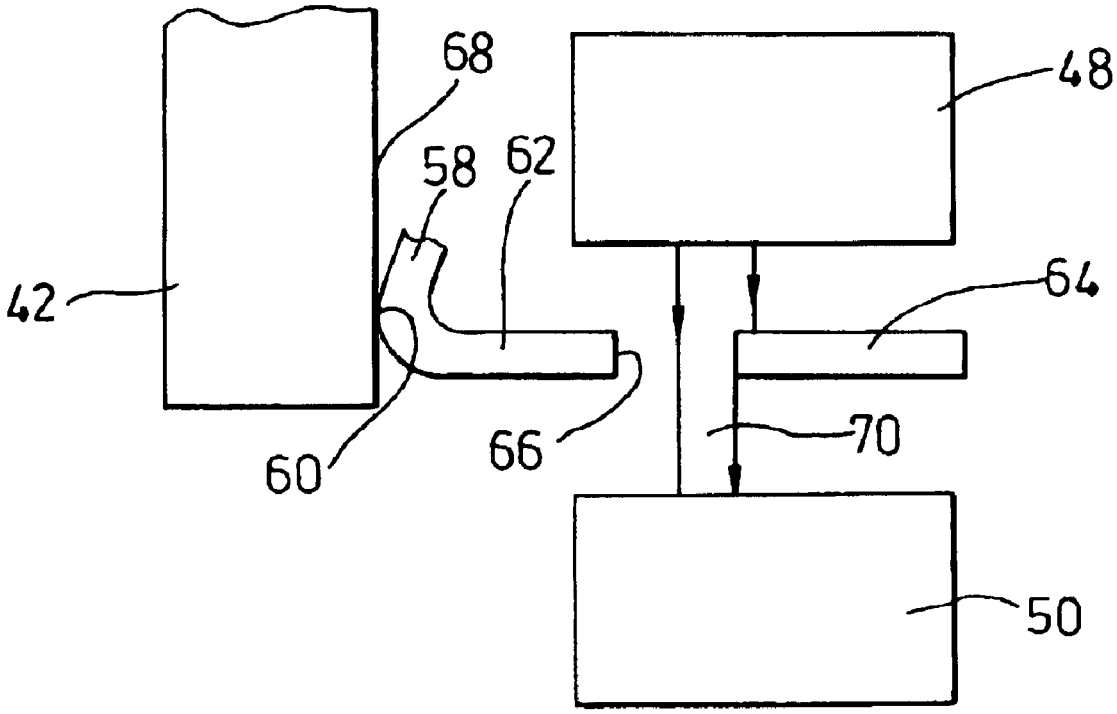
FIG. 2 is an enlargement of part of FIG. 1 showing an optical trigger position sensor.
Figure 3C:
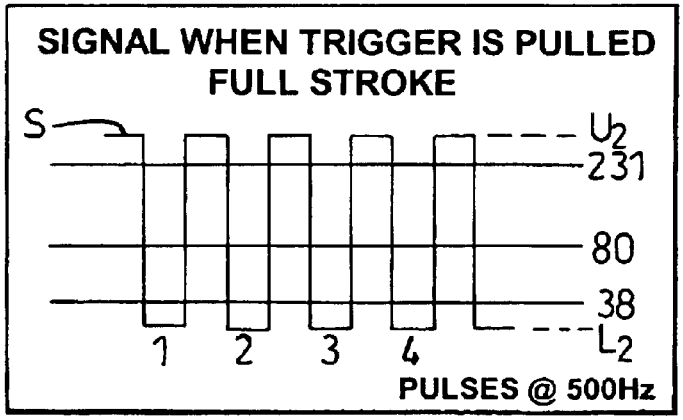
Figure 3D:
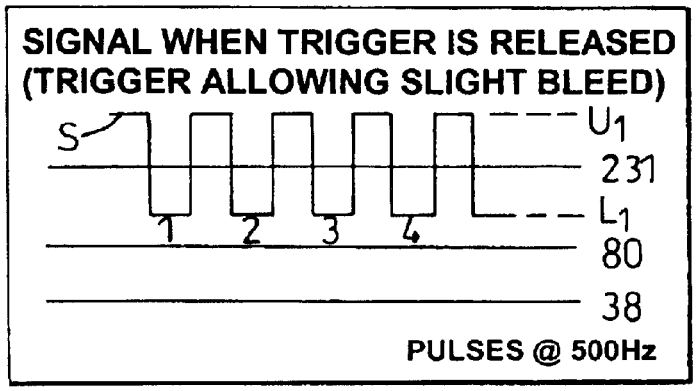

Referring to FIG. 3*c*, when the trigger 42 is depressed, i.e., pulled rearwards, to the right as shown in FIGS. 1 and 2, the actuator spring 52 moves rearwards. The optical window 66 therefore moves into alignment with the light beam 70 so that, with increasing trigger depression, the amount of light reaching the collector 50 increases. When the trigger 42 is fully depressed, the optical window 66 is aligned with the light beam 70. This allows substantially all of the light beam 70 to reach the collector 50. Therefore, in response to pulsing of the light beam 70, the collector signal oscillates between an unlit value $U_2$, which is higher than the dark state threshold 231, and a lit value $L_2$, which is lower than the fully depressed threshold 38. Therefore, on each pulse, the signal level passes through all three of the thresholds 231, 80 and 38 between the lit value $L_2$ and the unlit value $U_2$.

When the trigger 42 is then fully released again, the actuator spring 52 moves forwards, to the left as shown in FIG. 1, until the blocking portion 64 fully blocks the beam 70. The collector signal then takes the form shown in FIG. 3*d*, which is the same as that in FIG. 3*b*.

Figure 3E:
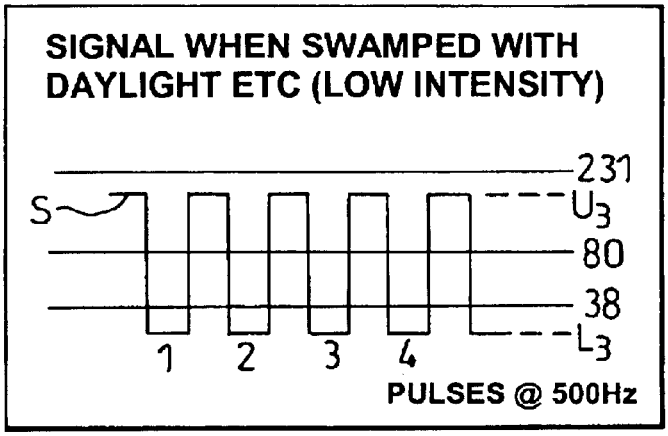
Figure 3F:
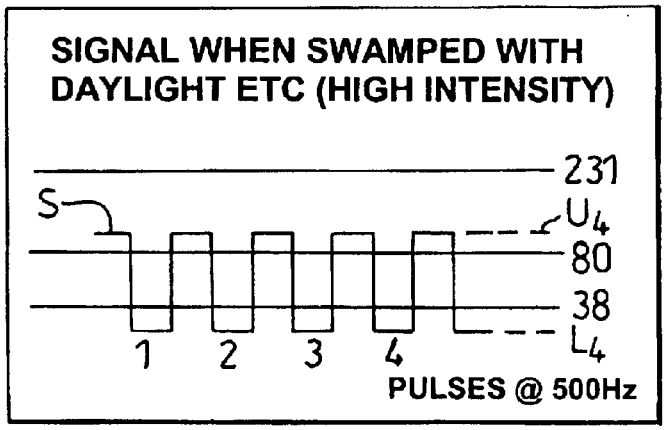

Referring to FIG. 3*e*, if the collector 50 becomes swamped with light, then the light levels reaching the collector 50 when the light beam 70 is off do not fall to the normal low level. The unlit value $U_3$ of the signal is therefore pulled below the dark state threshold 231 so that it lies between the dark state threshold 231 and the intermediate threshold 80. The lit value $L_3$ remains at substantially zero since high levels of light will reach the collector 50 when the beam 70 is on. Therefore, in each pulse, the collector signal passes through the intermediate threshold 80 and the fully depressed threshold, but not the dark state threshold. FIG. 3*f* shows how the collector signal varies with higher levels of light swamping than those of FIG. 3*e*. The lit value $L_4$ is still approximately zero, but the unlit value $U_4$ is lower than that in FIG. 3*e* due to the higher light levels.

Control of firing of the gun 10 in response to operation of the trigger 42 will now be described. In most guns, due to competition rules, one shot only must be fired for each pull of the trigger 42. Therefore, the controller 20 must be set up to detect each pull of the trigger 42, and-to detect release of the trigger 42 between pulls. In order to register a pull of the trigger 42, the controller 20 must detect that the trigger 42 is in the fully depressed position. For this to happen in this embodiment, the pulsed light signal must be detected as being present, and of sufficient brightness to indicate that the trigger 42 is in the depressed position. Firstly, the signal must be detected at one sample time to be above the dark state threshold 231. This therefore requires that the light beam 70 is not reaching the collector 50 and that no light swamping is occurring. Then, in the next sampling period, the lit value of the signal must be detected as being below the fully depressed threshold 38. This requires the trigger 42 to be in the fully depressed condition, and the beam 70 to be on. Then, the signal must be detected to rise above the released threshold 80, and finally the unlit value of the signal must rise above the dark state threshold 231. When these requirements have been met, a pull is registered and a single shot is fired.

Then no further shots will be fired until a trigger release has been registered, indicating the end of the first pull. To register a release in this embodiment, the controller 20 must detect firstly that the signal is above the dark state threshold 231. This indicates that the beam 70 is off and no light swamping is occurring. Then it must detect that the signal remains above the intermediate threshold 80 at the next sampling time, indicating that the light beam 70 is on, but the trigger 42 has moved forwards to at least the intermediate position blocking a substantial part of the beam 70. Then, at the next sampling time, it must again detect the signal as being above the dark state threshold, indicating no light swamping. Once the release has been registered, the next detection of a pull will trigger another shot.

The thresholds are programmable so that the characteristics of the trigger 42 can be varied. It will be appreciated that the difference between the fully depressed threshold and the intermediate threshold will determine the amount of trigger movement that is needed between registering of a pull and registering of a release. This distance needs to be greater than the amplitude of trigger bounce, which is the movement of the trigger while it is resting against a player's finger, which is nominally still. This ensures that the player has to positively move his trigger finger to produce each shot.

In order to avoid the gun 10 firing accidentally, for example, when it is dropped, the controller 20 needs to be able to distinguish between a pull of the trigger 42 by a player and sharp movements of the trigger 42 caused by vibration of the gun 10. In order to do this, the controller 20 includes a snubber function, which defines a minimum depressed time for which the trigger 42 must be held in the depressed position before a shot will fire. This minimum depressed time needs to be at least as long as the ring time for which the gun 10 will vibrate or resonate if it is struck, for example, if it is dropped. Tests on this particular gun indicate that this time is approximately 25 ms, and the minimum depressed time is therefore set to 30 ms, corresponding to 15 pulses of the light beam 70, to give a margin of safety. Obviously, for other guns, the ring time can vary.

The snubber function in this embodiment is defined as having been met if, in one period, the signal is above the dark state threshold of 231, then, in the next sample time, the signal is below the fully depressed state value 38, then at least 15 pulses are counted in which the lit value of the signal is below the fully depressed state value 38, then the lit value of the signal rises to above the released value 80.

However, the minimum depressed time only applies to the first shot in a series of shots. This means that the requirement needs to be met to initiate a series of shots but, once a series has been started, the snubber is deactivated, provided the shots in the series are within a predetermined time of each other. This is because good players can achieve a firing rate that is faster than one every 50 ms. Therefore, once one pull has been detected with the minimum depressed time requirement, that requirement is deactivated and any subsequent shots fired within a predetermined time of each other (in this example, 1.25 s) do not need to meet this requirement. However, as soon as a snubber re-activation period of 1.25 s does pass without a shot being registered, the minimum depressed time requirement is re-activated, and will apply to at least the first shot in the next series of shots.

It will be appreciated that the minimum depressed time and the snubber reactivation time can be varied to suit a particular gun or player. For example, in some circumstances, the snubber is only required to be re-activated when a player has finished a game and left the field, rather than after each series of shots. In this case, the snubber re-activation time can be of the order of 1 minute. In some cases, it is desirable to have a minimum depressed time for each shot fired. This can be used to avoid trigger bounce, which is the unintentional rapid vibration of the trigger 42 on the player's finger, causing multiple shots to be fired. It may, therefore, be desirable to have a shorter minimum depressed time for all except the first shot in a series of shots, the first shot having a longer minimum depressed time associated with it, as described above. In a still further modification, it can be desirable to include a minimum released time, for which the trigger 42 must be in the released position before a trigger release is registered, and a further shot can be fired. The control of the minimum released time would be provided in the same way as the minimum depressed time as described above, with the collector signal needing to be in the form shown in FIG. 3*d* for at least a predetermined time for a release to be registered. This minimum released time can further help to prevent multiple shots being fired unintentionally as a result of trigger bounce.

Figure 2A:
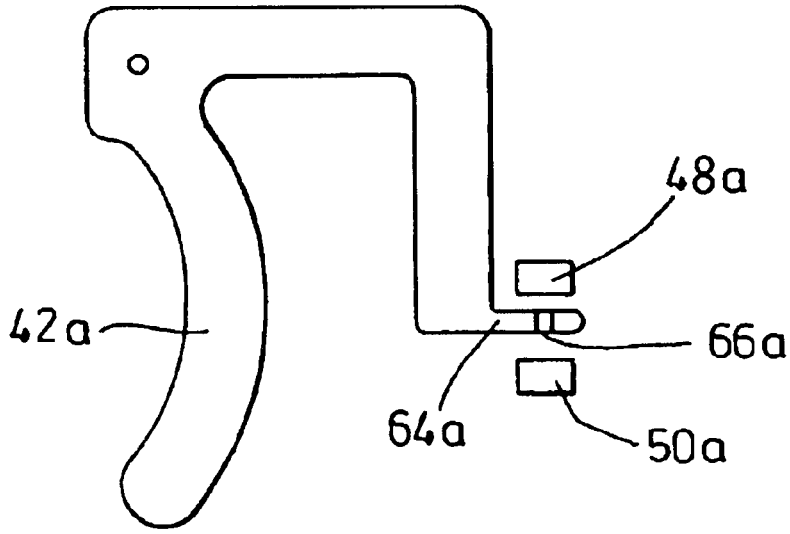
FIG. 2*a* is a side cutaway view of an alternate embodiment corresponding to FIG. 2 of a modification to the embodiment of FIG. 1.

Referring to FIG. 2*a*, in a modification to the first embodiment, the trigger 42*a* includes a projection 64*a* on its rear edge, which is formed integrally with it and acts as the actuation member, extending between the optical emitter 48*a* and collector 50*a*. The projection 64*a* has a hole 66*a* drilled through it which performs the same function as the aperture 66 in the embodiment of FIG. 2. In a further modification, the spring or trigger may not have an aperture, but may simply have an end that moves between the emitter and collector during either pulling or releasing of the trigger.

It will be appreciated that various other modifications can be made to the embodiment described above. For example, instead of being set up so that the light from the emitter 48 reaches the collector 50 when the trigger 42 is depressed, but not when it is released, the system can equally be set up so that light from the emitter 48 reaches the collector 50 when the trigger 42 is released, but is blocked when the trigger 42 is depressed. This can be achieved, for example, simply by moving the window 66 on the spring 52. In this case, to provide the minimum depressed time, the controller 20 needs to detect when the intensity of light from the light beam 70 reaching the collector 50 falls below a certain threshold, and then start a timer. If the minimum depressed time elapses before the light intensity rises above the threshold again, then a shot is fired. In some cases, it is also possible to omit the pulsing of the light from the emitter 48 altogether. The signal produced by the collector 50 is therefore of a steady value which remains constant for any given position of the trigger 42, but which varies through the 256 grey scale values with trigger position. In this case, thresholds in the collector signal value can still be used to detect when the trigger 42 reaches the pulled and released positions, respectively. This can be monitored, for example, by sampling the collector signal at regular intervals, or by detecting when the signal passes through any of the defined thresholds.

Figure 4:
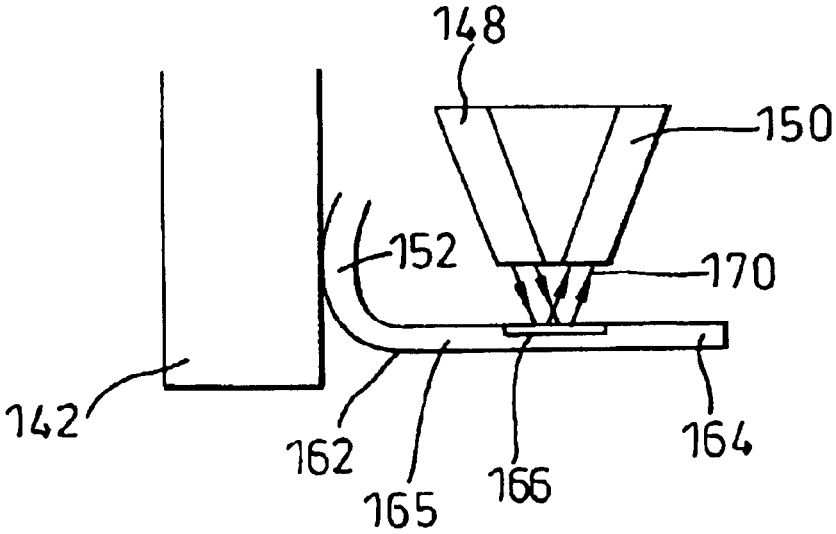
FIG. 4 is a side cutaway view showing an optical trigger sensor forming part of a trigger system according to a second embodiment of the invention.

Referring to FIG. 4, in a second embodiment of the invention, many of the parts are similar to those of FIGS. 1 and 2, and corresponding parts are indicated by the same number, but increased by 100. The aperture 66 in the actuator spring 52 is replaced by a reflective area 166 on the upper surface of the lower end 162 of the actuator spring 152, which is bounded by non-reflective areas 164, 165. The optical emitter 148 and detector 150 are arranged on the same side of the lower end 162 of the spring, and angled such that light from the emitter 148 can be reflected onto the detector 150 by the reflective area 166 when it is aligned with the beam 170 of emitted light. It will be understood that this embodiment will operate in the same manner as the first embodiment, with the amount of light detected by the-detector 150 varying as the reflective area 166 moves into and out of alignment with the emitted light beam 170. Again, the reflector 166 can be set up so that the collector 150 receives more light when the trigger 142 is in the depressed position, or when the trigger 142 is in the released position.

Figure 5:
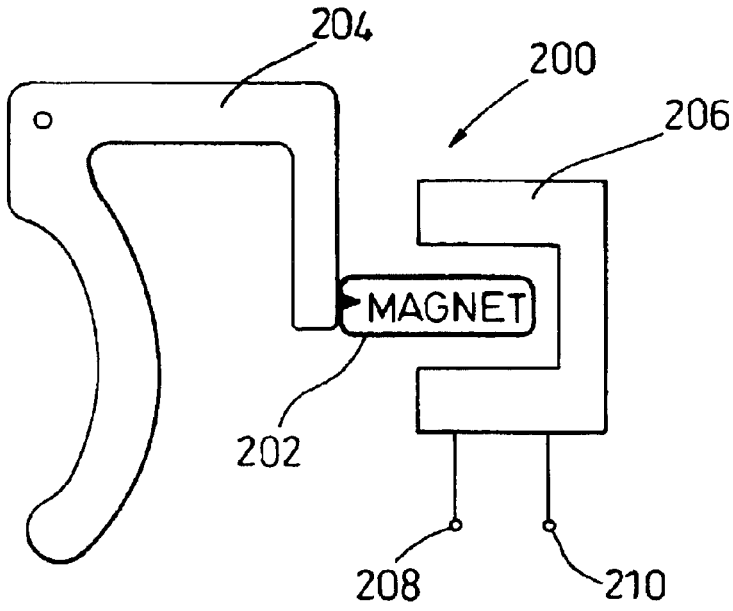
FIG. 5 is a side elevational view of a Hall effect trigger sensor forming part of a trigger system according to a third embodiment of the invention.

Referring to FIG. 5, in a third embodiment of the invention, the optical sensor of the first and second embodiments is replaced by a Hall effect sensor 200. This comprises a magnet 202 mounted on the trigger 204, which moves within a cavity in a solid state device 206. A current is passed through the conductor in the solid state device 206 and the electrical potential across the conductor, as measured between the two terminals 208, 210, varies with the position of the magnet 202, and hence with the position of the trigger 204. The Hall effect potential produced in the solid state device 206 can therefore be measured and used as a measure of the position of the trigger 204. Thresholds of the value of the potential can be set to define positions of the trigger 204, which will cause a pull and a release of the trigger 204 to be registered.

Figure 6:
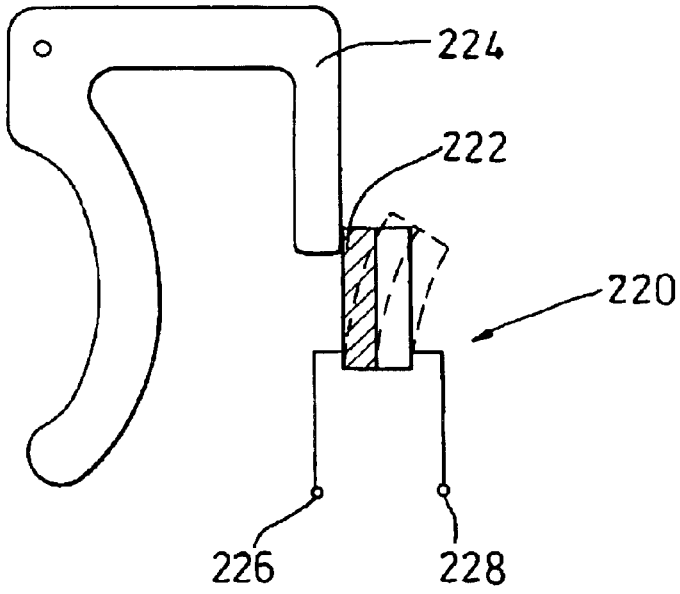
FIG. 6 is a side elevational view of a piezoelectric trigger sensor forming part of a trigger system according to a fourth embodiment of the invention.

Referring to FIG. 6, in a fourth embodiment of the invention, the trigger sensor comprises a piezoelectric sensor 220. This includes a piezoelectric crystal 222, which is arranged to have a force applied to it when the trigger 224 is pulled. The piezoelectric crystal is connected into an electrical circuit including two terminals 226, 228, and the application of a force to the crystal 222 causes it to produce an electric voltage between the terminals 226, 228 and hence the voltage can be measured and used to determine when the trigger 224 is being pulled or released.

Figure 7:
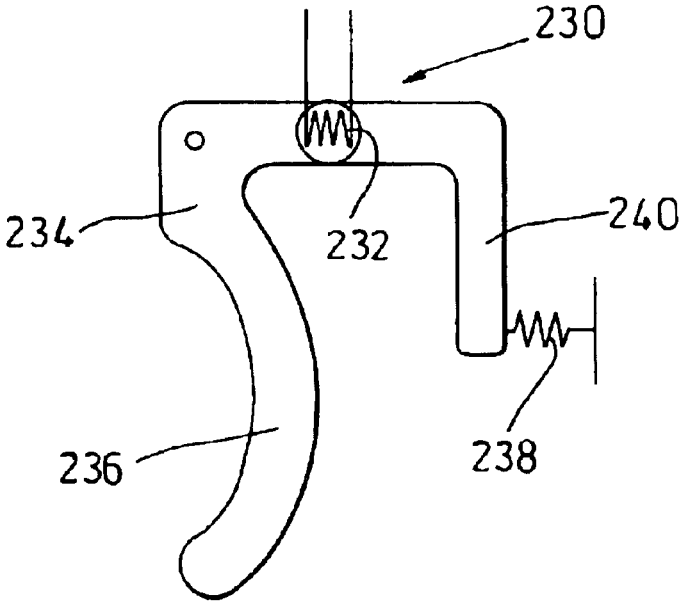
FIG. 7 is a side elevational view of a strain gauge trigger sensor forming part of a trigger system according to a fifth embodiment of the invention.

Referring to FIG. 7, in a fifth embodiment-of the invention, the trigger position sensor comprises a strain gauge 230. This comprises a resistor 232, which is mounted on the trigger 234, and the resistance of which varies with the amount of strain experienced by the trigger 234. Pulling of the trigger 234, by a user, causes a force to be applied to a finger, engaging portion 236, and movement of the trigger is resisted by a spring 238 acting on an abutment portion 240 of the trigger 234. As the force applied increases, the spring 238 is compressed and the strain on the trigger 234 increases. This allows the position of the trigger 234 to be measured by measuring the resistance of the resistor 232. In a modification to this embodiment, the spring 238 can be replaced by a rigid stop so that applying a force to the trigger 234 does not cause it to move at all, but still increases the strain on the trigger as measured by the strain gauge 230. In this case, pulling and releasing of the trigger are defined purely in terms of the force on the trigger 234 rather than its position.

Figure 8:
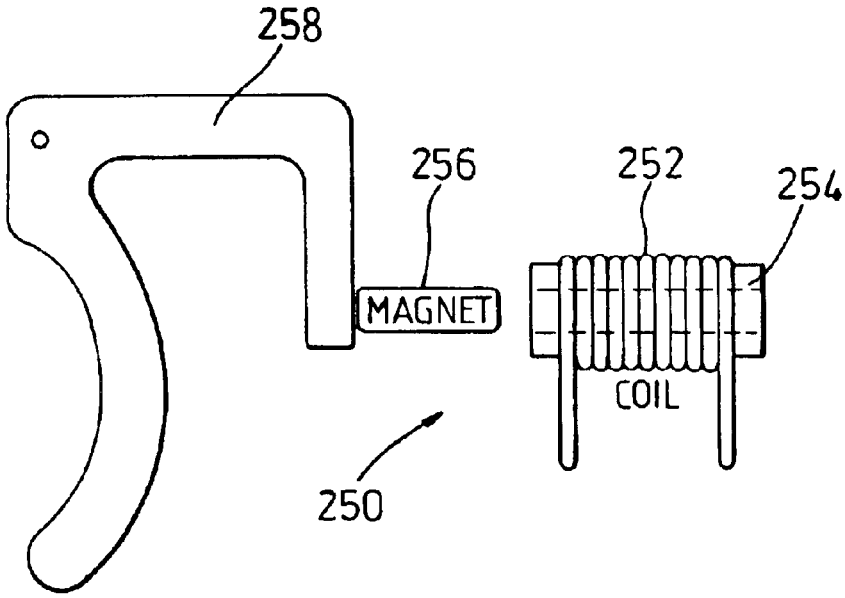
FIG. 8 is a side elevational view of an inductive trigger sensor forming part of a trigger system according to a sixth embodiment of the invention.

Referring to FIG. 8, in a sixth embodiment of the invention, the trigger position sensor comprises an inductive sensor 250, which comprises a conductive coil 252 wound round a magnetic core 254. A magnet 256 is connected to the trigger 258 to move with it and is located close to the core 254 so that movement of the trigger 258 varies the magnetic field in the core 254. This, in turn, produces an electric current in the coil 252, which can be measured to measure movements of the trigger 258.

Figure 9:
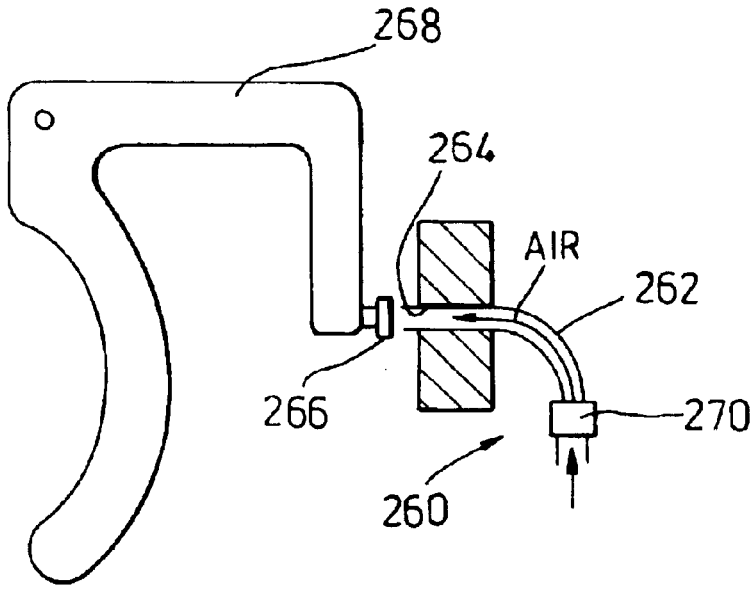
FIG. 9 is a side elevational view of an air gauge trigger sensor forming part of a trigger system according to a seventh embodiment of the invention.

Referring to FIG. 9, in a seventh embodiment of the invention, the trigger position sensor comprises an air gauge 260. This comprises a duct 262, which is connected to a supply of pressurized air. The duct opens to atmosphere at a port 264. A stopper 266 is mounted on the trigger 268 such that, when the trigger 268 is in the released position, the stopper 266 is just clear of the port 264. When the trigger is pulled, the stopper 266 covers the port 264 and restricts the flow of air along the duct 262. A flow meter 270 measures the rate of flow along the duct, and, hence, measures the position of the trigger 268.

Figure 10:
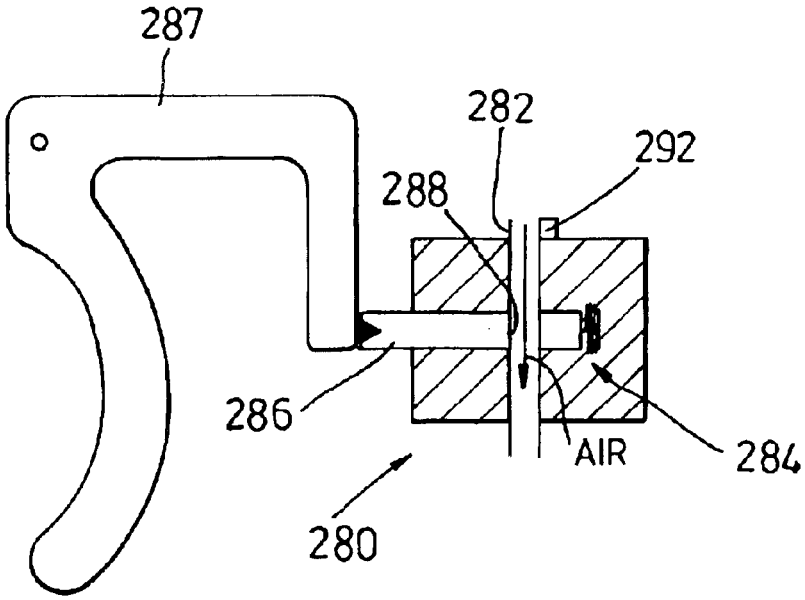
FIG. 10 is a side elevational view of an air pressure trigger sensor forming part of a trigger system according to a eighth embodiment of the invention.

Referring to FIG. 10, in an eighth embodiment of the invention, the trigger position sensor comprises an air pressure sensor 280. This comprises a duct 282 through which air is passed from a pressurized air source. A valve 284 is provided in the duct in the form of a rod 286 with an aperture 288 through it which can be aligned with the duct 282 to allow air to flow past it, or moved out of alignment with the duct 282 against the force of a return spring 290 to close of the duct 282. The rod 286 is connected to the trigger 287. A pressure sensor 292 in the duct upstream of the valve 284 measures the air pressure in the duct, and, hence, the degree to which the valve 284 is open or closed. This, in turn, provides a measure of the position of the trigger 287.

Figure 11:
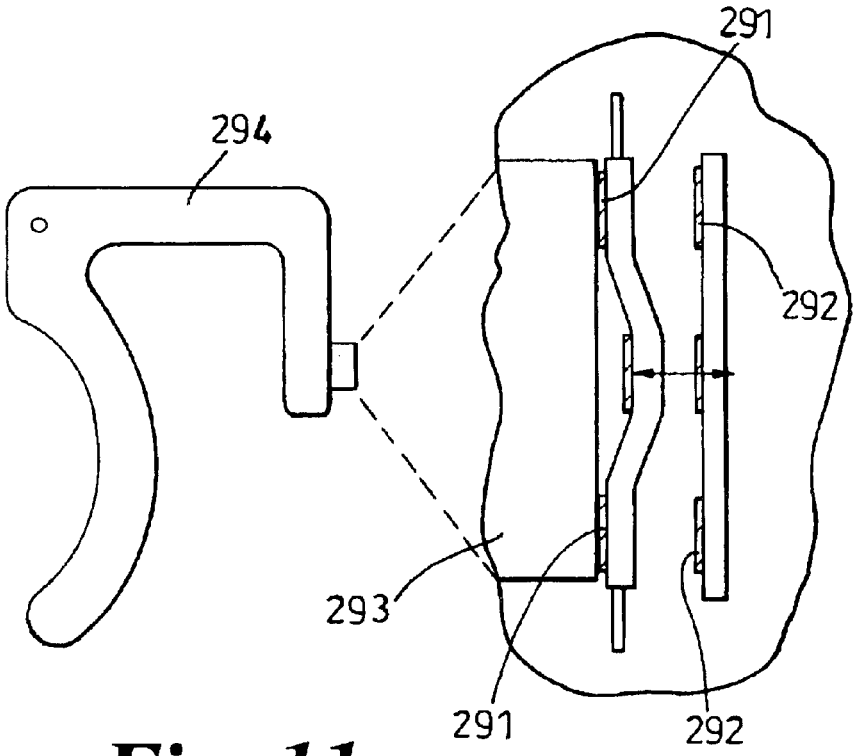
FIG. 11 is a side elevational view of a capacitance trigger sensor forming part of a trigger system according to a ninth embodiment of the invention, including a blow up of one portion of the capacitance trigger sensor.

Referring to FIG. 11, in a ninth embodiment of the invention, the trigger position sensor comprises a capacitance sensor 290. This comprises a number of metal plates 291, 292, some of which 291 are mounted on and move with the trigger 293 and some of which 292 are mounted in a fixed position where they will not move with the trigger 293, for example, on the grip frame or printed circuit board. The plates 291 form a capacitor. As the trigger moves, the plates 291 mounted on it move relative to the other plates, and the capacitance of the capacitor changes, which can be detected in known manner.

Figure 12:
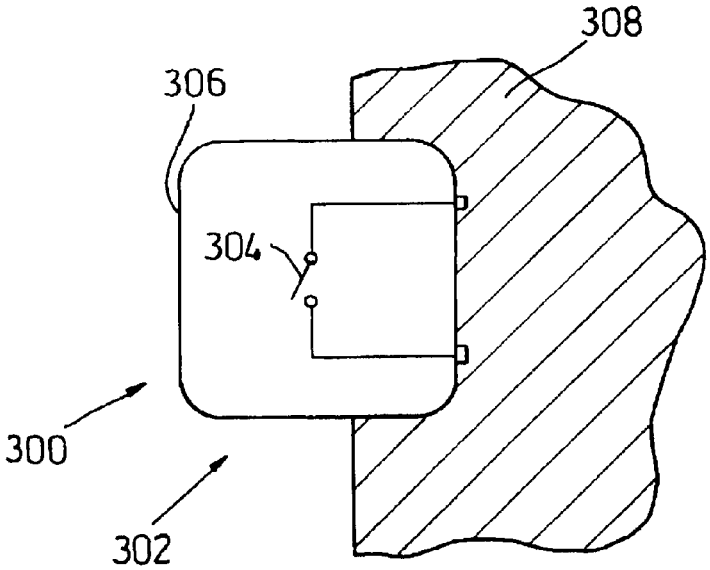
FIG. 12 is a side cutaway view of a tactile switch forming part of a trigger system according to a tenth embodiment of the invention.

Referring to FIG. 12, in a tenth embodiment of the invention, the trigger 300 is formed as a tactile switch 302. This comprises an electrical switch 304, which closes a circuit when pressed, and a tactile covering 306, which covers the switch and insulates it from exterior environment. The tactile covering is exposed on the front of the grip 308 of a paintball gun. The user simply presses the tactile covering 306 to close the switch and releases it to open the switch. The amount of force applied to, and therefore, also the position of, the tactile covering 306 determines whether the switch 304 is open or closed. The tactile covering 306, therefore, serves as the trigger in this embodiment.

It will be appreciated that the trigger systems of the embodiments described above could be used with any electrically controlled firing mechanism for a paintball gun.

It will also be appreciated that, in any of the embodiments described above, the gun could be a multi-function type, which is capable of firing a number of shots per pull of the trigger. In this case, the shots will start as soon as a pull is registered, but will stop as soon as a release is registered. This ensures that the gun will not continue to fire after the user has released the trigger.

What is claimed is:

1. A paintball gun trigger system comprising a trigger arranged to be movably mounted on a paintball gun so as to have a variable position, an optical sensor arranged to produce a signal that varies with the position of the trigger, and a controller arranged to receive the signal from the sensor so that it can determine when the trigger has been operated, wherein the sensor comprises an emitter arranged to emit light and a collector arranged to receive an amount of the light that varies with the position of the trigger and to vary said signal in response to variations in said amount of the light, wherein the sensor includes an actuator member arranged to move in response to movement of the trigger so as to vary the amount of light from the emitter which is received by the collector, and the actuator member is movable between the emitter and the collector.

2. A system according to claim 1, wherein the emitter is arranged to emit the light in pulses whereby the collector is arranged to produce said signal such that it pulses between a lit value and an unlit value in response to said pulses of light.

3. A system according to claim 2, wherein the controller is arranged to use the lit value of the signal to determine the position of the trigger.

4. A system according to claim 2, wherein the controller is arranged to use the unlit value of the signal to determine the position of the trigger.

5. A system according to claim 2, wherein the controller is arranged to define a dark state threshold, and to monitor the unlit value of the signal, and to inhibit firing of the gun if the unlit value reaches the dark state threshold.

6. A system according to claim 2, wherein the controller is arranged to define a light state threshold, and to monitor the lit value of the signal, and to inhibit firing of the gun if the lit value reaches the light state threshold.

7. A paintball gun including a trigger system according to claim 1.

8. A paintball gun trigger system according to claim 1, wherein the controller is arranged to define a minimum depressed time for which the trigger must be held in the depressed position to initiate firing of to gun.

9. A system according to 8, wherein the controller is arranged to determine from the signal when the trigger is depressed.

10. A system according to claim 8, wherein the controller is arranged to determine front the signal when the trigger is depressed.

11. A system according to claim 8, wherein the controller is arranged to define a minimum depressed time activation period, and to activate the minimum depressed thus requirement only after the trigger has not been pulled for the minimum depressed time activation period.

12. A system according to claim 11, wherein said minimum depressed time activation period is at least 300 ms.

13. A system according to claim 12, wherein said minimum depressed time activation period is at least 1.0 s.

14. A system according to claim 11, wherein the controller is arranged to define a series of activations of the trigger as a series of shots including a first shot and at least one subsequent shot, and to activate the minimum depressed time requirement only for the first shot whereby tie at least one subsequent shot can be fired without the trigger being held in the depressed condition for the minimum depressed time.

15. A paintball gun trigger system according to claim 1, wherein the controller is arranged to define a released state threshold of the signal corresponding to a released condition of the trigger, and a depressed state threshold of the signal corresponding to a depressed condition of the trigger, and to register a pull of the trigger only if the signal reaches the depressed state threshold and to register a further pull of the trigger only after the signal has returned to the released state threshold.

16. A system according to claim 15, wherein the depressed state threshold is offset from the released state threshold.

17. A system according to claim 15, wherein the controller is arranged to control the paintball gun to fire one shot for each registered pull of the trigger.

18. A system according to claim 15, wherein the trigger is arranged to be movable between a depressed position and a released position, and the depressed state threshold corresponds to the depressed position and the released state threshold corresponds to the released position.

19. A system according to claim 15, wherein the trigger is arranged to be depressed by a finger of a user, and the depressed position and the released position are separated by a distance corresponding to a movement of said finger of at least 0.01 mm.

20. A system according to claim 19, wherein the depressed position and the released position are separated by a distance corresponding to a movement of said finger of approximately 0.05 mm.

21. A system according to claim 19, wherein the depressed position and the released position are separated by a distance corresponding to a movement of said finger of substantially 0.06 mm.

22. A system according to claim 15, wherein the sensor is arranged to measure force applied to the trigger and the controller is ranged to define the depressed state threshold to correspond to a first predetermined depressing force being applied to the trigger.

23. A system according to claim 22, wherein the controller is arranged to define the released state threshold to correspond to a second predetermined depressing force being applied to the trigger.

24. A system according to claim 22, wherein the first predetermined depressing force is less than 1000 grams.

25. A system to claim 24, wherein the fist predetermined depressing force is of the order of 20 grams.

26. A paintball gun trigger system according to claim 1, wherein the controller is arranged to define a minimum depressed time for which the trigger must be held in the pulled condition to initiate firing of to gun.

27. A paintball gun trigger system according to claim 1, wherein the controller is arranged to define a released state threshold of the signal corresponding to a released condition of the trigger, and a depressed state threshold of the signal corresponding to a pulled condition of the trigger and to register a pull of the trigger only if the signal reaches the depressed state threshold and to register a further pull of the trigger only after the signal has returned to the released state threshold.

28. A system according to claim 1, wherein the actuator member is integral with the trigger.

29. A system according to claim 1, wherein the controller is arranged to determine when the trigger has been operated from variations in the signal.

30. A system according to claim 1, wherein the controller is arranged to prevent multiple shots being fired as a result of trigger bounce.

31. A system according to claim 30, wherein the controller is further arranged to vary the amount of time required before accepting a new signal.

32. A system according to claim 31, wherein the amount of time required before accepting a new signal corresponds with a minimum depressed time for which the trigger must be held in the depressed position to initiate firing of the gun.

33. A system according to claim 1, wherein the controller is arranged to vary the amount of time required before accepting a new signal based on at least one of: the group comprising a particular gun and a player.

34. A system according to claim 1, wherein the controller is arranged to vary the amount of time required before accepting a new signal between a minimum and a maximum.

35. A paintball gun trigger system comprising a trigger arranged to be movably mounted on a paintball gun so as to have a variable position, an optical sensor arranged to produce a signal which varies with the position of the trigger, and a controller arranged to receive the signal from the sensor so that it can determine when the trigger has been operated, wherein the sensor comprises an emitter arranged to emit light and a collector arranged to receive an amount of the light which varies with the position of the trigger, and to vary said signal in response to variations in said amount of the light, wherein the sensor includes an actuator member arranged to move in response to movement of the trigger so as to vary the amount of light from the emitter which is received by the collector, the trigger is movable between a depressed position and a released position, and the actuator member has a blocking portion that is arranged to block more of the emitted light when the trigger is in one of the released position and the depressed position than when it is in the other of said positions.

36. A system according to claim 35, wherein said one position is the depressed position.

37. A system according to claim 35, wherein said one position is the released position.

38. A system according to claim 35, wherein the emitter is arranged to emit the light in pulses whereby the collector is arranged to produce said signal such that it pulses between alit value and an unlit value in response to said pulses of light.

39. A system according to claim 35, wherein the controller is arranged to prevent multiple shots being fired as a result of trigger bounce.

40. A system according to claim 39, wherein the controller is further arranged to vary the amount of time required before accepting a new signal.

41. A system according to claim 40, wherein the amount of time required before accepting a new signal corresponds with a minimum depressed time for which the trigger must be held in the depressed position to initiate firing of the gun.

42. A system according to claim 35, wherein the controller is arranged to define a minimum depressed time for which the trigger must be held an the depressed position to initiate firing of the gun.

43. A system according to claim 35, wherein the controller is arranged to vary the amount of time required before accepting a new signal based on at least one of: the group comprising a particular gun and a player.

44. A system according to claim 35, wherein the controller is arranged to vary the amount of time required before accepting a new signal between a minimum and a maximum.

45. A paintball gun trigger system comprising a trigger arranged to be movably mounted on a paintball gun so as to have a variable position, an optical sensor arranged to produce a signal which varies with the position of the trigger, and a controller arranged to receive the signal from the sensor so that it can determine when the trigger has been operated, wherein the sensor comprises an emitter arranged to emit light and a collector arranged to receive an amount of the light which varies with the position of the trigger, and to vary said signal in response to variations in said amount of the light, wherein the sensor includes an actuator member arranged to move in response to movement of the trigger so as to vary the amount of light from the emitter which is received by the collector, and the trigger is movable between a depressed position and a released position, and the actuator member has a reflector thereon that is arranged to reflect an amount of light from the emitter to the collector, which mount is arranged to be greater when the trigger is in one of the released position and the depressed position than when it is in the other of said positions.

46. A system according to claim 45, wherein said one position is the depressed position.

47. A system according to claim 45, wherein said one position is the released position.

48. A system according to claim 45, where the emitter is arranged to emit the light in pulses whereby the collector is arranged to produce said signal such that, it pulses between a lit value and an unlit value in response to said pulses of light.

49. A system according to claim 45, wherein the controller is arranged to prevent multiple shots being fired as a result of trigger bounce.

50. A system according to claim 49, wherein the controller is further arranged to vary the amount of time required before accepting a new signal.

51. A system according to claim 50, wherein the amount of time required before accepting a new signal corresponds with a minimum depressed time for which the trigger must be held in the depressed position to initiate firing of the gun.

52. A system according to claim 45, wherein the controller is arranged to define a minimum depressed time for which the trigger must be held in the depressed position to initiate firing of the gun.

53. A system according to claim 45, wherein the controller is arranged to vary the amount of time required before accepting a new signal based on at least one of: the group comprising a particular gun and a player.

54. A paintball gun trigger system comprising a trigger arranged to be movably mounted on a paintball gun so as to have a variable position, an optical sensor arranged to produce a signal which varies with the position of the trigger, and a controller arranged to receive to signal from the sensor so that it can determine when the trigger has been operated, wherein the sensor comprises an emitter arranged to emit light and a collector arranged to receive an amount of the light which varies with the position of the trigger, and to vary said signal in response to variations in said amount of the light, wherein the sensor includes an actuator member arranged to move in response to movement of the trigger so as to vary the amount of light from the emitter which is received by the collector, and the trigger is movable between a depressed position and a released position, and the actuator member has an aperture through which light from the emitter can pass to reach the collector when the trigger is in one of the depressed position and the released position.

55. A system according to claim 54, wherein said one position is the depressed position.

56. A system according to claim 54, wherein said one position is the released position.

57. A system according to claim 54, wherein the emitter is arranged to emit the light in pulses whereby the collector in arranged to produce said signal such that it pulses between a lit value and an unlit value in response to said pulses of light.

58. A system according to claim 54, wherein the controller is arranged to prevent multiple shots being fired as a result of trigger bounce.

59. A system according to claim 58, wherein the controller is further arranged to vary the amount of time required before accepting a new signal.

60. A system according to claim 59, wherein the amount of time required before accepting a new signal corresponds with a minimum depressed time for which the trigger must be held in the depressed position to initiate firing of the gun.

61. A system according to claim 54, wherein the controller is arranged to define a minimum depressed lime for which the trigger must be held in the depressed position to initiate firing of the gun.

62. A system according to claim 54, wherein the controller is arranged to vary the amount of time required before accepting a new signal based on at least one of: the group comprising a particular gun and a player.

63. A paintball gun trigger system comprising a trigger arranged to be movably mounted on a paintball gun so as to have a variable position, an optical sensor arranged to produce a signal which varies with the position of the trigger, and a controller arranged to receive the signal from the sensor so that it can determine when the trigger has been operated, wherein the sensor comprises an emitter arranged to emit light and a collector arranged to receive an amount of the light which varies with the position of the trigger, and to vary said signal in response to variations in said amount of the light, wherein the sensor includes an actuator member arranged to move in response to movement of the trigger so as to vary the amount of light from the emitter which is received by the collector, and the actuator member comprises a spring acting on the trigger.

64. A system according to claim 63, wherein the controller is arranged to define a minimum depressed time for which the trigger must be held in the depressed position to initiate firing of the gun.

65. A system according to claim 63, wherein the controller is arranged to vary the amount of time required before accepting a new signal based on at least one of: the group comprising a particular gun and a player.

66. A paintball gun trigger system comprising a trigger arranged to be movably mounted on a paintball gun so as to have a variable position, an optical sensor arranged to produce a signal which varies with the position of the trigger, and a controller arranged to receive the signal gun the sensor so that it can determine when the trigger has been operated, wherein the sensor comprises an emitter arranged to emit light and a collector arranged to receive an amount of the light which varies with the position of the trigger, and to vary said signal in response to variations in said amount of the light, wherein the sensor includes an actuator member arranged to move in response to movement of the trigger so as to vary the amount of light from the emitter which is received by the collector, and the actuator member is formed integrally with the trigger.

67. A system according to claim 66, wherein the controller is arranged to define a minimum depressed time for which the trigger must be held in the depressed position to initiate firing of the gun.

68. A system according to claim 66, wherein the controller is arranged to vary the amount of time required before accepting a new signal based on at least one of: the group comprising a particular gun and a player.

69. A paintball gun trigger system according to claim 1, wherein the controller is arranged to define a minimum released, time for which the trigger must be in the released position before a further trigger pull can be registered.

70. A system according to claim 69, wherein the controller is arranged to determine from the signal when the trigger is depressed.

71. A system according to claim 69, wherein the controller is arranged to determine from the signal when the trigger is released.

* * * * *